United States Patent [19]

Castellini et al.

[11] Patent Number: 4,805,671

[45] Date of Patent: Feb. 21, 1989

[54] DEVICE FOR THE CONTROL OF THE WEFT YARN IN THE LOOMS OPERATED BY COMPRESSED AIR

[75] Inventors: Carlo Castellini; Giuseppe Longobardi, both of Firenze, Italy

[73] Assignee: Instituto Nazionale Di Ottica, Italy

[21] Appl. No.: 51,489

[22] Filed: May 18, 1987

[51] Int. Cl.[4] ..... D03D 51/34

[52] U.S. Cl. ..... 139/370.2

[58] Field of Search ..... 139/336 R, 370.1, 370.2

[56] References Cited

U.S. PATENT DOCUMENTS

| | | | |
|---|---|---|---|
| 4,188,981 | 2/1980 | Suekane et al. | 139/370.2 |
| 4,592,394 | 6/1986 | Bobbola | 139/370.2 |
| 4,716,942 | 1/1988 | Jensen | 139/370.2 |

FOREIGN PATENT DOCUMENTS

| | | | |
|---|---|---|---|
| 163448 | 9/1984 | Japan | 139/370.2 |
| 26850 | 6/1985 | Japan | 139/370.2 |
| 1245348 | 10/1986 | Japan | 139/370.2 |
| 1239058 | 10/1986 | Japan | 139/370.2 |

*Primary Examiner*—Henry S. Jaudon

*Attorney, Agent, or Firm*—McGlew and Tuttle

[57] ABSTRACT

The device includes optical means for the reflection of a pencil of energy of the luminous type, that reaches a sensor, which reflection optical means are formed by surfaces optically polished having the thickness of a hollow of a metallic foil inserted between two blades of the reed; on the optical path or course there are provided first optical cylindrical condensation means of the energy towards the first of said surfaces, which precedes the crossing of the channel where the weft is located, and second optical condensation means, after said crossing and towards the sensor.

5 Claims, 2 Drawing Sheets

Fig. 1
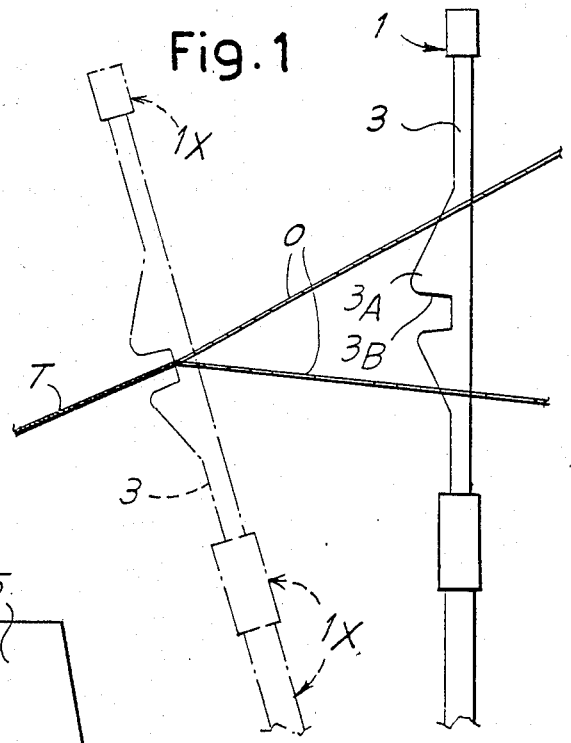
Fig. 2
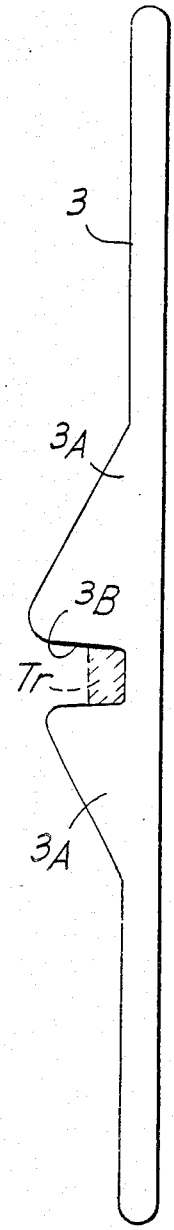
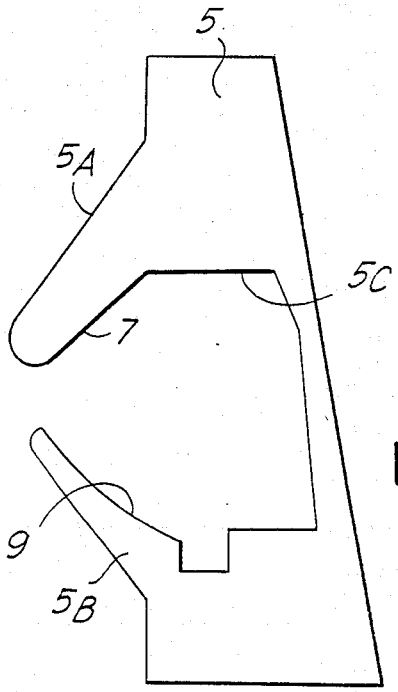
Fig. 3

DEVICE FOR THE CONTROL OF THE WEFT YARN IN THE LOOMS OPERATED BY COMPRESSED AIR

DESCRIPTION

The invention concerns a device for the control of the weft yarn inserted in the shed, in the looms operated by compressed air of the textile industry, including a reed with blades shaped with hollows to define the channel for the weft yarn inserted by the air stream. Said device includes optical means for the reflection, through the channel, of a pencil of energy of the luminous type, which reaches a sensor suitable for generating a signal owing to the change of energy that strikes it when the weft yarn is present and absent in the zone of the channel wherein the device is placed.

An improved device—to assure resistance to the mechanical stresses, compactness, stability and economy—according to the invention provides: that said optical means are formed by surfaces optically polished with the thickness of a hollow of a foil inserted between two blades of the reed; and that, on the optical path or course, first means for condensation of the energy towards the first of said surfaces which precedes the crossing of the channel, and second means for condensation after said crossing and towards the sensor are to be provided.

In practice said first condensation means comprise a cylindrical lens with the generating line parallel to the foil lying position, between the light source and a first reflection surface; said second means for condensation are formed by a second reflection surface, that is developed as a cylindrical ruled surface orthogonal to the foil lying position.

Advantageously the foil is metallic and shaped as a C letter, thus showing an ample hollow; it is received between two blades of the reed and, at the opposite side of the channel for the throwing of the weft, in respect to the blades of the reed, houses within its hollow the sensor, the source of light and the first condensation means.

By this structure the above mentioned purposes and advantages and others are reached, which will result evident to those skilled in the art from the reading of the text that follows.

The invention will be better understood by following the description and the accompanying drawing, that shows a practical non-limitative exemplification of the invention itself. In the drawing:

FIG. 1 shows a functional diagram of a loom operated by air;

FIG. 2 shows separately a blade of the reed;

FIG. 3 shows separately the foil with hollow and the shaped surfaces of thickness;

Figure 4:
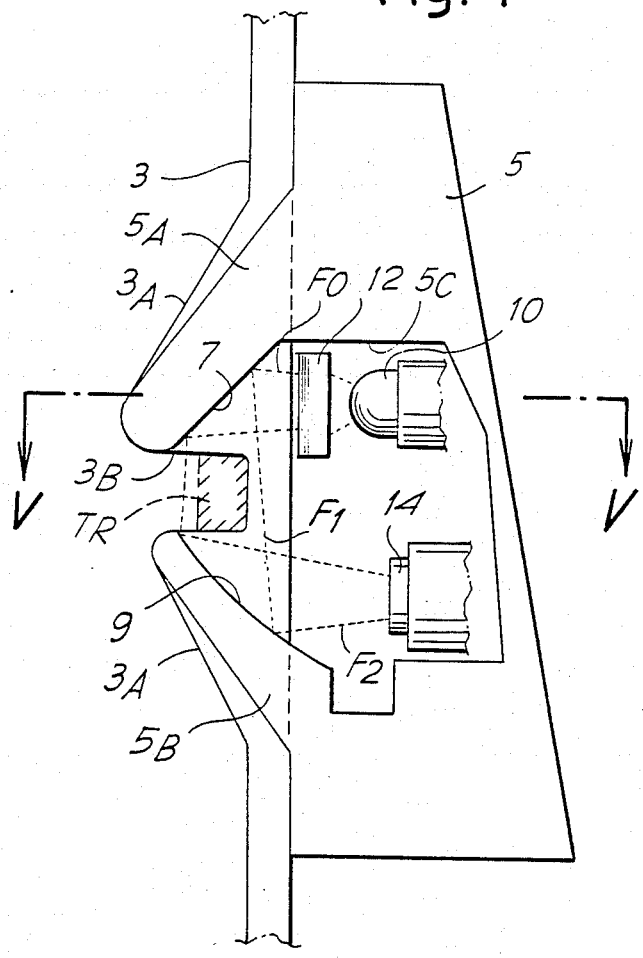
FIG. 4 shows the foil placed on the reed and equipped with the components of the optical system (generator, condenser, sensor)
Figure 5:
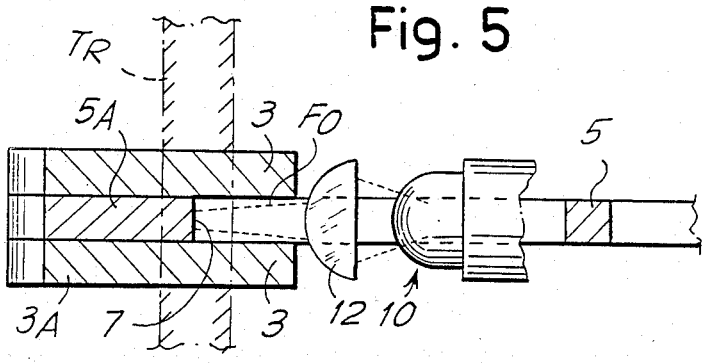
FIG. 5 is an enlarged section view according to line V—V of FIG. 4.

According to what is illustrated in the enclosed drawing, 1 generically indicates the beater, which must move from the position indicated by full line up to the position 1X indicated by a line of dashes, to approach the weft to the fabric T as it is being formed; numeral 0 indicates the warp yarns, which define the space for the throwing of the weft since they converge up to the fabric being formed; the warps are cyclically changed in their positions by the so-called warp heddles (or healds) or heddle type reeds. The beater is constituted by a reed formed by a plurality of blades 3, which—in the particular case of the loop operated by air—are shaped as shown in the drawing with an enlarged portion 3A and a hollow 3B, while the sequence of the hollows 3B in the various flanking blades 3 of the reed define the channel wherein the weft yarn is thrown through the air jet. In particular the zone of the channel, where the weft yarn deposited by the air-operated throwing of the same yarn is placed, is indicated by a hatching TR. The blades 3 are relatively very thin and also the space between the blades 3 is very limited, about 4–6 tenths of a millimeter, as far as both the thickness and the interspace are concerned. The beatings of the loom are very frequent in the looms operated by air (which are fed generally with very thin yarns) and then the pain or fatigue of the material forming the beater or which is combined with the beater is considerable.

A problem that exists in the looms operated by air is that of the control of integrity of the weft yarn every time inserted by the air-operated throwing. The device in question concerns a particularly improved solution of a detection system of the weft integrity. It has to be noted that the integrity of an inserted weft yarn can be evaluated by the presence or the absence of said weft yarn in the channel formed by the hollows 3B at the end opposite to that wherefrom the insertion of the weft takes place, in respect to the front of the reed, then also at the outside of the reed zone where the warp yarns are present between a blade 3 and the other. The device, according to the invention, in order to detect the presence or the absence of the inserted weft yarn and then the regularity of insertion of the weft and the integrity of the inserted weft, is applied just in the zone of the reed, wherein the space between the blades 3 is free from warp.

According to the invention, between two blades 3 of the end zone of the reed where the inserted weft yarn arrives, a metallic foil 5 is placed having opposite major surfaces defining a foil thickness according to the interspace between the blades; the foil 5 is shaped with two appendixes 5A and 5B, which penetrate into the interspace between the two blades 3 and which are spaced apart at their converging ends for an entity that substantially corresponds to the width of the hollow 3B of blades 3 of the reed; said foil is shaped with an ample hollow or cavity 5C that substantially defines the shape of the foil 5 as a C letter; the hollow 5C projects from the blades 3 of the reed at the opposite side in respect to that where the channel for the weft is formed, while the converging ends of the two appendixes 5A and 5B of the foil 5 substantially correspond more or less to the external ends of the hollows 3B forming the channel.

The foil 5 has minor surfaces extending transversely between said major surfaces defining edges and is shaped at the internal profile of its appendix 5A with a first minor surface portion 7 that is specular and plane orthogonally to the lying position both of the foil 5 and of the blades 3, with a slant more or less of 45° towards the channel of the weft. A second internal minor surface portion 9 of the appendix 5B of the foil 5 is slightly hollow and is treated as well in such a way to be specular from the optical point of view.

In the deepest portion of the hollow 5C of the foil 5 a source of energy is placed having luminous behaviour or even being luminous within the visible field or close to the visible field, such as a LED type source generically indicated by 10. In front of the light source 10 and between this and the reflecting surface 7 an optical condenser 12 is placed, which consists of a cylindrical lens with the generating line parallel to the lying position of the blades 3 and the foil 5 that forms the reflecting surfaces 7 and 9. Therefore the beam of luminous energy coming from the source 10 is condensed towards the cleft defined between the two blades 3 wherein the foil 5 is inserted, the condensation taking place perpendicularly to the direction of the cleft and not in the lying position of the cleft; F0 indicates the converging beam of the luminuous energy which has crossed the condenser 12 and reaches the optically reflecting surface 7. The foil type beam of condensed light is reflected by the surface 7 by a beam F1 that extends across the channel for the throwing of the weft, thus interesting particularly all the zone TR wherein the weft yarn is present when it is complete, that is, intact. The beam of luminous energy F1 reaches the optically reflecting surface 9, which, being shaped with a hollow cylindrical surface—with circular or better elliptical directrix—perpendicular to the lying position of the blades 3, forms a cylindrical mirror suitable for condensing in the plane of the foil 5 the received beam F1, to form a beam F2, that therefore results in being condensed both orthogonally to the lying position of the foil 5 and in the plane of the foil 5 because of the effect of the two condensation systems 12 and 9. The condensed beam F2 reaches a sensor 14 generically indicated, which can be a photodiode or other, that receives, transforms and elaborates the luminous signal by amplifications and other to obtain the signalling or any way the control of what can be associated to the control device in question. The sensibility of the sensor 14 and the assembly of the optical reflection and condensation system are such that the sensor 14 receives and detects a signal having different values depending on the presence or the absence of the weft yarn in the zone TR, an operating signal being thus obtained. It has to be noted that the presence of the weft yarn at the arrival end of the inserted weft corresponds to the integrity of the inserted weft, since the possible breakage of the weft yarn during the insertion causes the escape thereof through the open side of the channel formed by the hollows 3B, whereby any breakage of the weft at any position of the front of the fabric being formed causes an absence of the weft in the zone of the channel wherein the survey through the device in question takes place. Obviously the survey is synchronized for any throwing of weft, for cadenced controls simultaneously to the beatings.

The source 10 and the sensor 14, and possibly even electronic parts associated with these components, can be placed in combination with the foil 5 on the end portion of the reed, wherein the foil 5 with its appendixes 5A and 5B is inserted in the blades 3. Therefore the device is particularly easy to place even in already existing looms.

The device results particularly compact and strong, since after all it has a structure including a foil 5 that forms itself the reflection surfaces 7 and 9, one of which forms also a condenser. The optically treated surfaces can be realized by a pack processing of a plurality of foils 5 for a plurality of devices. Therefore the processing is economic and the device cost is particularly low. The reflection surfaces of the metallic foil 5 are particularly resistant to external agents ensuring a long life. They are also continuously cleaned by the air jet working for the throwing of the weft, so that the operation of the optical reflecting system is particularly reliable. The condensations of the energy of the luminous type towards the sensor permit the assurance of an operation that is particularly reliable from the optical point of view, to obtain a reliable signal of the presence and the absence and then of the integrity or breakage of the inserted weft.

It must be understood that the drawing shows only an exemplification, and is merely given as a practical demonstration of the invention, being the invention able to vary in its forms and dispositions without any way departing from the scope of the idea informing the same invention.

We claim:

1. In an air jet weaving loom including a reed having a plurality of closely spaced blades with recesses aligned to define a channel along which the weft yarn is inserted by an air stream, a device for detecting the presence of the weft yarn inserted in the shed including a one-piece, planar, metallic foil having opposite major surfaces defining the foil thickness and minor surfaces extending transversely between said major surfaces defining edges, portions of said edges having been optically polished to provide first and second, spaced apart, specular surfaces, the foil being inserted in the space between two adjacent blades of the reed with said major surfaces adjacent respective blades and with the specular surfaces located on opposite sides of the channel defining first and second reflection surfaces, respectively; said foil being C-shaped, opening in the same direction as the channel and providing a cavity extending from the opposite sides of the channel, said reflection surfaces spanning the space between adjacent blades of the reed; a light source and a light sensor, placed within said cavity defined by said metallic foil, the light source being arranged to direct a beam of light towards the first specular reflection surface, so that the light beam is reflected by the first reflection surface across the channel to the second reflection surface which reflects the light beam to the sensor.

2. A device according to claim 1, wherein light condensing means are placed between the said light source and the first of said reflection surfaces for condensing the beam in a direction extending transversely of the major surfaces onto the first reflection surface.

3. A device according to claim 2, wherein said condensing means comprise a cylindrical lens with the generating line parallel to the major surfaces of said foil.

4. A device according to claim 1, wherein said second reflection surface is developed as a cylindrical, concavely profiled ruled surface orthogonal to the major surfaces of the foil forming a further light condensing means.

5. An optical reflector for mounting between adjacent reed blades of an air jet weaving loom having recesses aligned to define a weft receiving channel, the reflector comprising a one-piece, planar C-shaped metallic foil having appendices and having opposite major surfaces defining the foil thickness and minor surfaces extending transversely between said major surfaces defining inner edges on the appendices of said foil extending from opposite sides of a component receiving cavity, portions of said edges having been optically polished to provide first and second, spaced apart specular surfaces for location on respective opposite sides of the channel with the space aligned with the channel, the first specular surface being arranged to reflect a beam of incident light from the direction of the cavity transversely across the space to the second specular surface which is arranged to reflect the beam transversely back to the direction of the cavity, and said second specular surface defining a convergent reflection surface.

* * * * *